US006532875B1

(12) United States Patent
Schweitzer

(10) Patent No.: US 6,532,875 B1
(45) Date of Patent: Mar. 18, 2003

(54) ACCESSORY AND METHOD FOR DESTROYING A MINE

(76) Inventor: Peter Schweitzer, 50 Spruce Ter., Wayne, NJ (US) 07470

( * ) Notice: Subject to any disclaimer, the term of this patent is extended or adjusted under 35 U.S.C. 154(b) by 0 days.

(21) Appl. No.: 10/060,809

(22) Filed: Feb. 1, 2002

(51) Int. Cl.[7] ..... F42B 7/02
(52) U.S. Cl. ..... 102/403; 102/402
(58) Field of Search ..... 102/402, 403, 102/275.12, 275.11, 204; 89/1.13; 169/28, 33; 280/741

(56) References Cited

U.S. PATENT DOCUMENTS 3,891,233 A * 6/1975 Damon ..... 137/516.17
4,066,415 A * 1/1978 Kasama et al. ..... 102/531
4,316,874 A * 2/1982 Kasama et al. ..... 280/741
4,530,516 A * 7/1985 Adams et al. ..... 280/735
4,578,247 A * 3/1986 Bolieau ..... 102/531
5,492,366 A * 2/1996 Osborne et al. ..... 102/202.5
5,665,231 A * 9/1997 Langsdorf et al. ..... 210/314
5,755,222 A * 5/1998 Pansard et al. ..... 128/204.26
5,780,764 A * 7/1998 Welch et al. ..... 102/275.4
5,799,972 A * 9/1998 Handman et al. ..... 102/209
5,970,841 A * 10/1999 Trocino ..... 89/1.13
6,227,115 B1 * 5/2001 Gruber et al. ..... 102/202.1

* cited by examiner

*Primary Examiner*—Charles T. Jordan
*Assistant Examiner*—Bret Hayes
(74) *Attorney, Agent, or Firm*—Thomas L. Adams

(57) ABSTRACT

A self-destruct accessory fits on a mine whose case has a cap that can be depressed to detonate the mine. The accessory has a cover that is sized to fit on the cap. The cover has a plurality of lines for securing the cover to the mine. An explosive charge is mounted upon the cover and a detonator is located adjacent to the explosive charge. A remotely controllable device coupled to the detonator can receive a detonation signal from a remote location to detonate the explosive charge and explosively depress the cap in order to detonate and destroy the mine.

18 Claims, 1 Drawing Sheet

FIG. 1
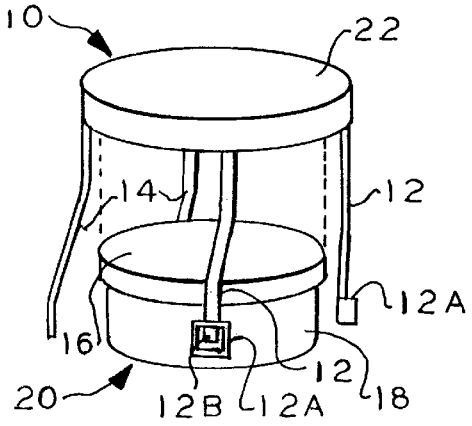
FIG. 2
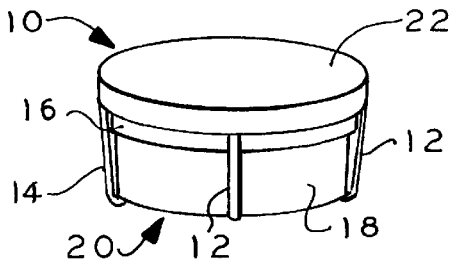
FIG. 3
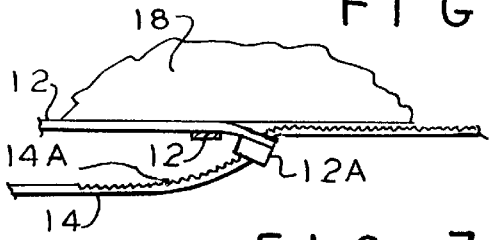
FIG. 4
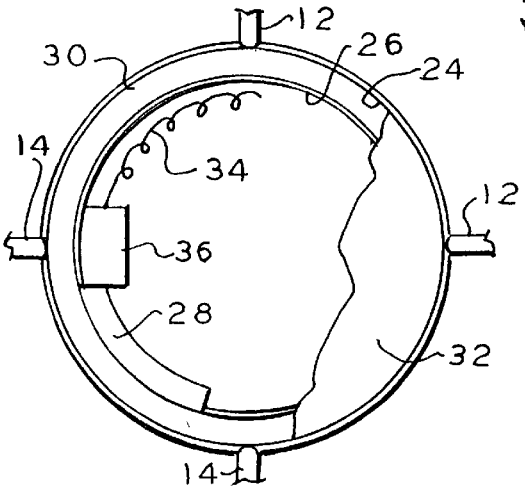
FIG. 7
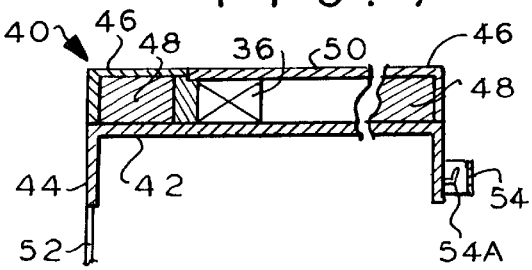
FIG. 5
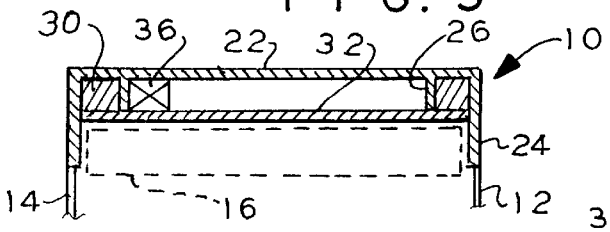
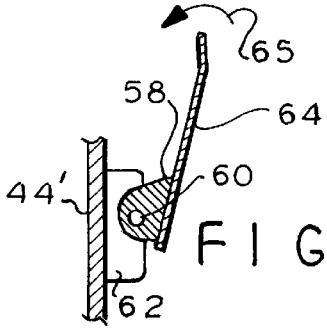
FIG. 8
FIG. 6
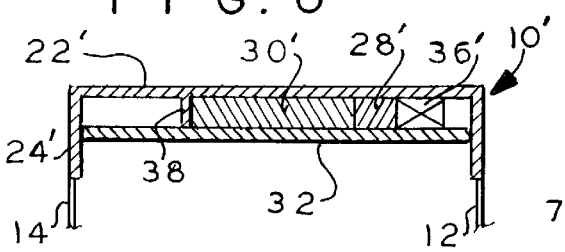
FIG. 9
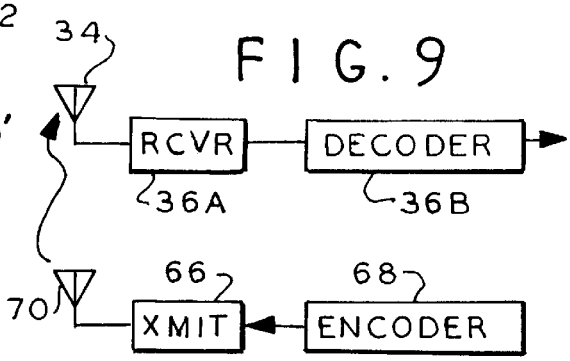

ACCESSORY AND METHOD FOR DESTROYING A MINE

BACKGROUND OF THE INVENTION

1. Field of the Invention

The present invention relates to mines, and in particular, to accessories that can be secured to a mine in order to destroy it.

2. Description of Related Art

Land mines are still considered a necessary part of warfare. Of course, a lingering problem is finding, and disabling or destroying the land mines after hostilities cease. While combatants may try to make maps indicating locations of land mines, these maps are often hastily made and inaccurate, or are lost in the destruction that is part of armed conflict. Oftentimes, there is simply not the resources available to devote the time needed for carefully tracking down, and extracting or detonating these mines.

There have been many proposals for disabling or destroying land mines after they are no longer needed. These designs have employed internal timing devices or remote controls for either disabling or detonating the mine. These features, however, are part of the original land mine as manufactured. Existing inventories of land mines cannot be simply modified to include these safety features.

For example, in U.S. Pat. No. 3,603,258 pin 106 punctures diaphragm 104 after a mine is armed. The punctured diaphragm allows piston 96 to slowly move and eventually operate a mechanism to self-destructively detonate the mine. This mechanism is internal and cannot be readily used to retrofit a mine to achieve self-destruction. See also U.S. Pat. No. 3,739,725 (hydroscopic material 18 gradually softens to withdraw pin 13, which causes a mine to self-destruct).

In U.S. Pat. No. 6,142,080 an electronic timer senses the cessation of spinning of a projectile to start a timer that eventually will electrically detonate the explosive charge. In U.S. Pat. No. 3,657,571 an electronic timer is used to self-destruct a land mine. In U.S. Pat. No. 6,244,184 a timer is started upon the launch of a projectile carrying submunition grenades. Capacitors in the timing circuits in each of the grenades self-destruct the grenades after a period of time. None of these technologies are readily implemented as a retrofit. See also U.S. Pat. No. 3,983,819.

Encoded signals have been used to trigger underwater devices designed to destroy underwater mines. In U.S. Pat. No. 4,369,709 an underwater device is armed after reaching a proper operating depth. The device can be detonated by coded signals received through a hydrophone. In U.S. Pat. No. 5,042,387 a device has an upper buoyant portion and a lower sinking portion, which are both able to attach to a mooring line of a mine. The upper and lower units detach and move toward the mine and the mine seat, respectively. A sonar signal from a surface ship detonates both devices to destroy the mine and to sever the mooring line. See also U.S. Pat. Nos. 4,696,234; 4,970,957; 5,771,833; and 6,308,633. These references concern highly specialized underwater equipment and do not teach techniques for simply retrofitting land mines in order to safely destroy or disable them.

In U.S. Pat. No. 5,415,103 an interrogation unit can program a land mine to set the conditions under which the land mine will detonate. See column 1, lines 16–17. The electrical firing circuit of U.S. Pat. No. 5,218,574 provides several operating modes for a land mine. In one mode, an electrolytic timing device can detonate the land mine after a predetermined delay.

In U.S. Pat. No. 4,856,431 a directional mine is armed by inserting firing unit 6, which is locked into place by pin 15. The mine can be detonated by firing the igniter 11. After a pre-programmed amount of time, however, an electromagnet retracts pin 15 to eject unit 17, thereby disarming the mine. This reference is relatively complicated and does not lend itself to a simple retrofit.

In U.S. Pat. No. 4,712,478 slider 30 has a passage that moves into position just before detonation to create a firing path. The land mine can be neutralized by an undefined circuit that fires detonator 44 before slider 30 is in the armed position. Alternatively, the battery that operates circuit 10 can run down and disable the land mine. This reference has no teachings that would allow a simple retrofit for existing land mines.

In U.S. Pat. No. 4,854,239 a munition is fired by two explosively powered pistons, if they are fired in a proper sequence before a third piston is fired. Premature firing of the third piston will fracture a component, which is then elevated to indicate the munition is disabled. Again, this complicated reference would not be suitable for a simple retrofit.

See also U.S. Pat. Nos. 3,115,834; 3,447,461; 3,667,387; 4,058,061; 4,712,480; 4,854,239; 5,511,482; and 6,112,668, cited in the pending U.S. patent application Ser. No. 09/578,096, filed May 25, 2000 by the same inventor. See also U.S. Pat. Nos. 3,667,387 and 3,994,227.

Accordingly, there is a need for a self-destruct accessory that can be installed on a land mine in a simple and reliable fashion.

SUMMARY OF THE INVENTION

In accordance with the illustrative embodiments demonstrating features and advantages of the present invention, there is provided a self-destruct accessory for a mine whose case has a cap that can be depressed to detonate the mine. The accessory includes a cover sized to fit on the cap and has a plurality of lines for securing the cover to the mine. Also included is an explosive charge mounted upon the cover and a detonator located adjacent to the explosive charge. Firing of the detonator can cause the explosive charge to explode. The explosive charge can explosively depress the cap when the cover is mounted on the cap. The accessory also includes a remotely controllable device coupled to the detonator for firing it.

According to another aspect of the invention a method employing an explosive cover can destroy a mine whose case has a cap that can be depressed to detonate the mine. The method includes the step of fitting on the cap the explosive cover. The cover holds an explosive charge and a detonator. Another step is securing the cover to the mine with a plurality of lines. The method also includes the step of sending a detonation signal to the detonator from a remote location to detonate the explosive charge and explosively depress the cap in order to detonate and destroy the mine.

By employing the foregoing principles, an improved technique is achieved for destroying a mine with a self-destruct accessory. In one preferred embodiment, a cover is designed to fit closely over the cap of a land mine. Preferably, a number of straps extend from the edge of the cover and are used to secure the cover to the land mine. The ends of the straps can be fastened together using various connectors or buckles. Alternatively, the straps can extend from the side of the cover and attach to a fastener on the opposite side of the cover. In any event, the cover is installed in such a way that the land mine can be deployed in the usual fashion and will explode when pressure is applied to be cover to depress the cap of the land mine.

In a preferred embodiment an explosive charge can be mounted atop a supporting plate of the cover. When the land mine is no longer needed, an encoded signal can be sent to a remotely controlled detonator in the cover. This detonator can ignite a primer that in turn detonates the main explosive charge. The main explosive charge produces a pressure wave that depresses the cap of the land mine so it explodes safely.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 1 is perspective view of an accessory about to be installed on a mine in accordance with principles of the present invention;

FIG. 2 is a perspective view of the accessory of FIG. 1 installed on the land mine;

FIG. 3 is a detailed, fragmentary view of the connection between the lines on the underside of the land mine of FIG. 2;

FIG. 4 is plan view of the underside of the cover of FIG. 1 with a portion of its supporting plate broken away to show the contents of the cover;

FIG. 5 is an elevational, cross-sectional view of the cover of FIG. 4;

FIG. 6 is a cross-sectional view of a cover that is an alternate to that shown in FIG. 5;

FIG. 7 is a cross-sectional, elevational view of a cover that is an alternate to that shown in FIG. 5 with a portion broken away for illustrative purposes;

FIG. 8 is a detailed, cross-sectional view of a fastener that is an alternate to that shown in FIG. 5; and FIG. 9 is a schematic block diagram of a receiver and transmitter that may be employed in the foregoing embodiments.

DETAILED DESCRIPTION OF THE PREFERRED EMBODIMENTS

Referring to FIGS. 1–5, a self-destruct accessory is shown as a cover 10 with two female mating lines 12 and two male mating lines 14. Preferably, the proximal ends of lines 12 and 14 are integrally molded to the edge of cover 10. Lines 12 are shown secured to the edge of cover 10 at the three and six o'clock positions, while lines 14 are at the nine and twelve o'clock positions. Other embodiments may have a different number of lines located at different positions that are not necessarily equidistantly spaced.

The distal ends of the female mating lines 12 each have a ratchet clasp 12A in the form of a hollow box that is open at two opposite ends. The ratchet clasp 12A contains an inclined tooth 12B, one such tooth being visible through the distal opening shown in FIG. 1. Clasp 12A is designed to receive the male mating line 14, which may be inserted in only one direction, retraction being prevented by the inclined tooth 12B. Ratchet clasp 12A may be a conventional type of clasp, often referred to as a zip tie.

Most of the length of such lines 12 and 14 are plastic straps with the male straps 14 having a series of ratchet teeth 14A on one side. The ratchet clasp 12A is integrally molded with the length of the rest of the line. In other embodiments, the clasp may be a plate with two parallel slots through which the mating strap 14 can be threaded. Various other types of buckles and fasteners may be used as well. In simplified embodiments, the lines may work without any fastener and may simply be tied together.

Cover 10 is designed to fit over the cap 16 that is mounted atop case 18 of the land mine 20. This land mine 20 is a conventional mine that detonates when downward pressure depresses cap 16. In this embodiment cover 10 has a circular outline in order to fit onto cap 16, but in other embodiments the cover may have a different outline designed to fit over another specific land mine with a different outline.

Cover 10 has a top plate 22 with an integral annular sidewall 24 designed to encompass cap 16. Mounted concentrically inside sidewall 24 is an internal annular wall 26 that extends over 300°, leaving an opening into which a booster charge 28 protrudes. Mounted under plate 22 between walls 24 and 26 is an annular explosive charge 30 that extends 360° and lies against booster 28. Circular bottom plate 32 fits closely inside the annular wall 24 and encloses the space under top plate 22.

An antenna 34 runs along the inside of wall 26 and connects to remotely controllable device 36, which has the receiver 36A and decoder 36B shown in FIG. 9. As explained further hereinafter, device 36 is able to ignite booster charge 28 in response to encoded signals received by antenna 34. Antenna 34, device 36, and booster charge 28 fit between plates 22 and 32, and are herein collectively referred to as a detonator.

Referring to the alternative embodiment of FIG. 6, components identical to those previously described in connection with FIGS. 1–5 bear the same reference numeral, while components that are only similar are identified with the same reference numeral but marked with a prime (').  Cover 10' has an upper plate 22' surrounded by an integral annular sidewall 24'. Plate 22' has a central chamber partially encompassed by internal wall 38 to hold a central explosive charge 30'. In this embodiment, explosive charge 30' has a cylindrical shape. Fitting in a gap in internal wall 38 is a booster charge 28', which can be ignited by detonator device 36'. Booster charge 28' is located between explosive charge 30' and detonator device 36'.

As before, explosive device 36' is connected to an antenna (not shown) for receiving encoded signals. In this embodiment, the components involved in the explosive chain are all centrally located inside cover 10', in contrast to the distributed, annular explosive charge 30 of FIG. 4.

Referring to FIG. 7, alternative cover 40 has a base plate 42 with an integral annular sidewall 44. Cover 40 also has mounted atop plate 42 an inverted annular channel 46 containing an annular explosive charge 48. Also mounted atop plate 42 to the inside of channel 46 is a detonator 36 that is identical to the one previously mentioned in connection with FIG. 4. As before, detonator 36 cooperates with an antenna and a booster charge (not shown). The booster charge fits in a gap in channel 46 (similar to the gap shown in wall 26 of FIG. 4) and can be ignited by detonator 36 to explode explosive charge 48. Detonator 36 is covered by an upper plate 50 that fits onto an annular outside ledge on the upper inside corner of channel 46.

Integrally molded on the bottom edge of annular sidewall 44 are two lines, one such line 52 being shown in FIG. 7. Two mating fasteners 54 (one visible in this view) are mounted on the side of annular sidewall 44. Fastener 54 is in the form of a tunnel through which line 52 can be threaded. An inclined tooth 54A inside fastener 54 allows insertion of line 52 in one direction (upwardly through fastener 54 in this view). Teeth (not shown) on the inside face of line 52 engage tooth 54A to ensure this unidirectional insertion. Fastener 54 operates in a manner similar to that associated with fastener 12A of FIG. 1.

Referring to FIG. 8, an alternative fastener is shown that can replace fastener 54 of FIG. 7. This fastener has an eccentric barrel 58 pivotally mounted on pin 60 between a pair of embossments 62 (one visible in this view) on annular sidewall 44' (corresponding to sidewall 44 of FIG. 7). The lever 64 mounted on eccentric barrel 58 can be used to manually rotate barrel 58 to change the spacing between sidewall 44' and barrel 58. By rotating lever 64 in the direction indicated by the arrow 65, the gap between barrel 58 and sidewall 44' is reduced so that a line (such as line 52 of FIG. 7) can be gripped between elements 58 and 44'.

Referring to FIG. 9, radio receiver 36A detects a radio signal from antenna 34 and applies the detected signal to decoder 36B. Receiver 36A can detect AM or FM signals modulated in a variety of fashions, especially pulse code modulation. The signal from receiver 36A is a series of encrypted bits that are sent to decoder 36B for decoding. If a self-destruct code is received, decoder 36B sends an ignition signal to a booster charge, for example booster charge 28 of FIG. 4. This encoded signal is produced by encoder 68 that modulates transmitter 66 to transmit an encoded signal through antenna 70.

To facilitate an understanding of the principles associated with the foregoing apparatus, its operation will be briefly described in connection with the embodiment of FIGS. 1–5 and 9. Land mine 20 is a conventional mine that an armed force may already have in inventory. Mine 20 lacks the ability to be destroyed by a remote control. For this reason, mine 20 is retrofitted with cover 10. Cover 10 is placed over cap 16 with sidewall 24 encircling cap 16 as shown in FIG. 5.

Cover 10 is secured in place by joining together each of the lines 14 with a mating line 12 on the opposite side of cover 10. As shown in FIG. 3 line 14 is inserted through the opening in fastener 12A. Teeth 14A ratchet over the inclined tooth 12B (FIG. 1). Tooth 12B is inclined to allow insertion of line 14 in one direction so that lines 12 and 14 can be tightened around mine 20 and will not loosen. Once lines 12 and 14 have been tightened they form two transverse bindings around mine 20 as shown in FIG. 2. Lines 12 and 14 are not tightened so much as to depress cap 16. Depression of cap 16 by tightening lines 12 and 14 is unlikely since normally about 35 pounds of force must be applied to depress cap 16 in order to detonate mine 20.

Mine 20 with the newly installed cover 10 can be returned to inventory or can immediately be used in combat. Mine 20 can be laid in the usual fashion at a theater of operations. Personnel or vehicles that cross over mine 20 will depress cap 16 in the usual fashion to detonate the mine.

After hostilities cease land mine 20 may still remain in place unexploded. Finding and exploding/disabling land mine 20 in the conventional manner is obviously extremely dangerous. This danger is augmented by the fact that the exact location of land mines may not be known because they were scattered randomly or because the map of their location was destroyed in the preceding conflict.

With the present accessory 10 land mine 20 can be exploded at a safe distance by field personnel. When appropriate, transmitter 66 (FIG. 9) can send over antenna 70 an encoded signal generated by encoder 68. This radiated signal is received by antenna 34 and detected by receiver 36A. Depending upon the transmitted code, decoder 36B can issue a signal to fire the booster charge 28 (FIG. 4).

Once ignited, booster charge 28 quickly explodes explosive charge 30. Cover 10 then explodes sending an upward pressure wave, but more importantly, a downward pressure wave. This downward pressure wave depresses cap 16 and explodes land mine 20.

It will be appreciated that the embodiment of FIG. 6 will operate in substantially the same fashion, except that the explosive chain will start from the side and propagate into the central explosive charge 30'. The embodiments of FIGS. 7 and 8 will operate in a manner similar to that of FIGS. 1–5; it is just that the manner of fastening the accessory to the land mine is different.

It is appreciated that various modifications may be implemented with respect to the above described, preferred embodiment. For example, the mine need not have a circular perimeter and may have a perimeter that is square, rectangular, polygonal, elliptical or shaped otherwise. The structure of the cover is may be made of a different number of components than illustrated herein. Also, the structural components of the cover may all be made of a similar material; or different components may be made from different materials, including plastics, metals, ceramics, composite materials, etc. Moreover, the explosive and booster charge can be made of a variety of materials of various shapes that may be positioned in any one of a number of different locations. Also, the encoded signal may be transmitted by radio frequency waves, visible light, infrared energy, acoustic waves, etc. In addition, the disclosed electrical circuit can be modified to include fewer or more features and may be fabricated from discrete electrical components, integrated circuits, etc. Also, the various components can have different sizes and shapes depending upon the desired volume, strength, thermal stability, etc.

Obviously, many modifications and variations of the present invention are possible in light of the above teachings. It is therefore to be understood that within the scope of the appended claims, the invention may be practiced otherwise than as specifically described.

I claim:

1. A self-destruct accessory for a mine having a case with a cap that can be depressed to detonate the mine, the accessory comprising:

a cover sized to fit on said cap and having a plurality of lines for securing said cover to said mine;

an explosive charge mounted on said cover for exploding said cover to produce perpendicular to said cover two oppositely directed pressure waves, one of said pressure waves directly propagating without deflection to depress said cap when said cover is mounted on said cap;

a detonator located adjacent to said explosive charge, firing of said detonator causing said explosive charge to explode; and a remotely controllable device coupled to said detonator for firing said detonator.

2. An accessory according to claim 1 wherein said plurality of lines comprise:

at least two lines extending from said cover at peripherally spaced positions to cross each other under said mine.

3. An accessory according to claim 1 wherein said plurality of lines comprise:

at least two pairs of mating lines extending from said cover, the mating lines of each of said pairs of lines extending from opposite peripheral positions in order to mate under said mine.

4. An accessory according to claim 3 wherein a female one of the mating lines of each of the two pairs of lines has a distal opening with an inclined tooth for implementing unidirectional movement in said opening by a male one of the mating lines.

5. An accessory according to claim 4 wherein the male one of the mating lines of each of the two pairs of mating lines has a rack of teeth for unidirectionally ratchetting over the inclined tooth.

6. An accessory according to claim 1 wherein said plurality of lines comprise:

at least two fasteners attached to said cover at peripherally spaced positions; and at least two lines extending from said cover at spaced positions opposite said at least two fasteners, said at least two fasteners being adapted to separately grip said at least two lines.

7. An accessory according to claim 1 comprising at least two buckles attached to said cover and adapted to buckle onto said at least two lines.

8. An accessory according to claim 1 wherein said lines are integrally molded in said cover.

9. An accessory according to claim 1 wherein said remotely controllable device comprises a decoder for decoding a remotely transmitted code.

10. An accessory according to claim 1 wherein said remotely controllable device comprises a radio frequency receiver.

11. An accessory according to claim 1 comprising:

a booster coupled to said detonator, said detonator igniting said booster in order to detonate said explosive charge.

12. A mine according to claim 1 wherein said explosive charge has an annular shape, said detonator being encircled by said explosive charge.

13. A mine according to claim 1 wherein said explosive charge is centrally located on said cover.

14. A mine according to claim 1 wherein said cover comprises a plate for supporting on one side said explosive charge and on an opposite side being adapted to mount onto the cap of said mine.

15. A method employing an explosive cover for destroying a mine having a case with a cap that can be depressed to detonate the mine, the method comprising the steps of:

fitting on said cap said explosive cover, said cover holding an explosive charge and a detonator;

securing said cover to said mine with a plurality of lines; and sending a detonation signal to said detonator from a remote location to detonate said explosive charge and explosively depress said cap in order to detonate and destroy said mine.

16. A method according to claim 15 wherein the step of securing said cover is performed by routing at least two lines from said cover at peripherally spaced positions to cross each other under said mine.

17. A method according to claim 15 wherein the step of securing said cover is performed by routing at least two pairs of mating lines from said cover, the mating lines of each of said pairs of lines extending from opposite peripheral positions and mating under said mine.

18. A method according to claim 15 wherein the step of sending said detonation signal is performed by transmitting a coded signal and decoding the coded signal at the detonator before detonating it.

* * * * *